US008471445B2

(12) United States Patent
Lenk

(10) Patent No.: US 8,471,445 B2
(45) Date of Patent: Jun. 25, 2013

(54) ANTI-REFLECTIVE COATINGS FOR LIGHT BULBS

(75) Inventor: Ronald J. Lenk, Woodstock, GA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 13/059,394

(22) PCT Filed: Aug. 14, 2009

(86) PCT No.: PCT/US2009/004662
§ 371 (c)(1),
(2), (4) Date: Apr. 29, 2011

(87) PCT Pub. No.: WO2010/021676
PCT Pub. Date: Feb. 25, 2010

(65) Prior Publication Data

US 2011/0193465 A1 Aug. 11, 2011

Related U.S. Application Data

(60) Provisional application No. 61/089,645, filed on Aug. 18, 2008.

(51) Int. Cl.
*H01J 5/16* (2006.01)

(52) U.S. Cl.
USPC ..... 313/110; 313/512

(58) Field of Classification Search
USPC ..... 313/512, 110–116
See application file for complete search history.

(56) References Cited

U.S. PATENT DOCUMENTS

| | | | | |
|---|---|---|---|---|
| 4,160,929 | A | 7/1979 | Thorington et al. | |
| 4,289,991 | A | 9/1981 | Schreurs | |
| 4,346,324 | A | 8/1982 | Yoldas | |
| 4,405,744 | A | 9/1983 | Greinecker et al. | |
| 4,584,428 | A | 4/1986 | Garlick | |
| 5,140,220 | A | 8/1992 | Hasegawa | |
| 5,363,009 | A * | 11/1994 | Monto | 313/110 |
| 5,433,738 | A | 7/1995 | Stinson | |
| 5,813,753 | A | 9/1998 | Vriens et al. | |
| 5,905,343 | A | 5/1999 | McCamant | |
| 6,066,861 | A | 5/2000 | Hohn et al. | |
| 6,504,301 | B1 | 1/2003 | Lowery | |

(Continued)

FOREIGN PATENT DOCUMENTS

| | | |
|---|---|---|
| EP | 0658933 B1 | 10/2001 |
| JP | 07-99372 A | 4/1995 |

(Continued)

OTHER PUBLICATIONS

Non Final Office Action for U. S. Appl. No. 12/678,287, mailed on Apr. 19, 2011, 12 pages.

(Continued)

*Primary Examiner* — Anh Mai
*Assistant Examiner* — Hana Featherly
(74) *Attorney, Agent, or Firm* — Morrison & Foerster LLP

(57) ABSTRACT

A light bulb having anti-reflective coatings on an inner surface and/or an outer surface of the shell of the light bulb. The anti-reflective coatings reduce light loss due to reflections at the interfaces between the interior of the bulb and the shell and between the shell and the exterior of the bulb. The light source may be either incandescent, fluorescent or LED.

39 Claims, 2 Drawing Sheets

U.S. PATENT DOCUMENTS

| | | | |
|---|---|---|---|
| 6,513,955 | B1 | 2/2003 | Waltz |
| 6,612,712 | B2 | 9/2003 | Nepil |
| 6,639,360 | B2 | 10/2003 | Roberts et al. |
| 6,655,810 | B2 | 12/2003 | Hayashi et al. |
| 6,685,852 | B2 | 2/2004 | Setlur et al. |
| 6,791,259 | B1 | 9/2004 | Stokes et al. |
| 6,842,204 | B1 | 1/2005 | Johnson |
| 6,963,688 | B2 | 11/2005 | Nath |
| 7,022,260 | B2 | 4/2006 | Morioka |
| 7,075,112 | B2 | 7/2006 | Roberts et al. |
| 7,078,732 | B1 | 7/2006 | Reeh et al. |
| 7,086,767 | B2 | 8/2006 | Sidwell et al. |
| 7,213,934 | B2 | 5/2007 | Zarian et al. |
| 7,264,527 | B2 | 9/2007 | Bawendi et al. |
| 7,288,798 | B2 | 10/2007 | Chang et al. |
| 7,319,293 | B2 | 1/2008 | Maxik |
| 7,344,279 | B2 | 3/2008 | Mueller et al. |
| 7,489,031 | B2 | 2/2009 | Roberts et al. |
| 7,884,544 | B2 | 2/2011 | Takezawa et al. |
| 8,154,190 | B2 | 4/2012 | Ishii et al. |
| 2002/0149312 | A1 | 10/2002 | Roberts et al. |
| 2003/0067265 | A1 | 4/2003 | Srivastava et al. |
| 2003/0214233 | A1 | 11/2003 | Takahashi et al. |
| 2004/0004435 | A1 | 1/2004 | Hsu |
| 2004/0113549 | A1 | 6/2004 | Roberts et al. |
| 2004/0245912 | A1 | 12/2004 | Thurk et al. |
| 2004/0264192 | A1 | 12/2004 | Nagata et al. |
| 2005/0031281 | A1 | 2/2005 | Nath |
| 2005/0084229 | A1 | 4/2005 | Babbitt et al. |
| 2005/0179379 | A1 | 8/2005 | Kim |
| 2005/0224829 | A1 | 10/2005 | Negley et al. |
| 2005/0243539 | A1 | 11/2005 | Evans et al. |
| 2005/0243552 | A1 | 11/2005 | Maxik |
| 2006/0007410 | A1 | 1/2006 | Masuoka et al. |
| 2006/0022214 | A1 | 2/2006 | Morgan et al. |
| 2006/0145172 | A1 | 7/2006 | Su et al. |
| 2006/0176699 | A1 | 8/2006 | Crunk |
| 2006/0187653 | A1 | 8/2006 | Olsson |
| 2006/0208260 | A1 | 9/2006 | Sakuma et al. |
| 2006/0274524 | A1 | 12/2006 | Chang et al. |
| 2007/0090391 | A1 | 4/2007 | Diamantidis |
| 2007/0090737 | A1 | 4/2007 | Hu et al. |
| 2007/0139949 | A1 | 6/2007 | Tanda et al. |
| 2007/0291490 | A1 | 12/2007 | Tajul et al. |
| 2008/0013316 | A1 | 1/2008 | Chiang |
| 2008/0061687 | A1 | 3/2008 | Cok et al. |
| 2008/0185600 | A1 | 8/2008 | Thomas |
| 2009/0001372 | A1 | 1/2009 | Arik et al. |
| 2009/0256167 | A1 | 10/2009 | Peeters et al. |

FOREIGN PATENT DOCUMENTS

| | | | |
|---|---|---|---|
| JP | 3351103 62 | | 11/2002 |
| WO | 02/061805 | A2 | 8/2002 |
| WO | 2005/060309 | A2 | 6/2005 |
| WO | 2007/069119 | A1 | 6/2007 |
| WO | 2007/130359 | A2 | 11/2007 |
| WO | 2009/054948 | A1 | 4/2009 |

OTHER PUBLICATIONS

Final Office Action for U.S. Appl. No. 12/678,287, mailed on Oct. 11, 2011, 9 pages.

International Preliminary Report on Patentability for PCT Patent Application No. PCT US2008/010713, mailed on Mar. 25, 2010, 6 pages.

International Search Report for PCT Patent Application No. PCT/US2008/010713, mailed on Nov. 21, 2008, 1 page.

International Preliminary Report on Patentability for PCT Patent Application No. PCT/US2008/011984, mailed on May 6, 2010, 5 pages.

International Search Report and Written Opinion for PCT Patent Application No. PCT/US2008/011984, mailed on Jan. 15, 2009, 6 pages.

International Search Report for PCT Patent Application No. PCT/US2009/004662, mailed on Oct. 5, 2009, 2 pages.

International Preliminary Report on Patentability for PCT Patent Application No. PCT/US2009/004662, mailed on Mar. 3, 2011, 9 pages.

Non Final Office Action for U.S. App. No. 12/739,944, mailed on May 16, 2012, 55 pages.

Extended European Search Report for European Patent Application No. 08842545.9, mailed on Jul. 26, 2012, 7 Pages.

* cited by examiner

ANTI-REFLECTIVE COATINGS FOR LIGHT BULBS

CROSS REFERENCE TO RELATED APPLICATIONS

This is a U.S. National Phase patent application of PCT/US2009/004662, filed Aug. 14, 2009, which claims priority to U.S. patent application Ser. No. 61/089,645, filed Aug. 18, 2008, all of which are hereby incorporated by reference in the present disclosure in their entirety.

FIELD OF THE INVENTION

The present invention relates to reducing optical losses of bulbs used for lighting, and more particularly, to the use of anti-reflective coatings on the inner and outer surfaces of the shells of the bulb in order match the index of refraction of the shell material to the indices of refraction of the inside/inner portion of the bulb and outside/ambient surroundings of the bulb, thus increasing the light output of the bulb being replaced.

BACKGROUND OF THE INVENTION

There are several types of light bulb now in use. The most common is still the incandescent bulb, formed by surrounding a very hot filament in a partial vacuum with a glass shell. Another common type is the fluorescent bulb, formed by surrounding a plasma column with a glass shell containing a phosphor, the phosphor serving to convert the ultraviolet radiation emitted by the plasma into visible light. Another type of bulb, rapidly gaining in popularity, is the LED (light emitting diode) bulb. One popular method of forming an LED bulb is to surround the LEDs with air or a fluid, gel or plastic, and encase the LEDs inside a plastic shell.

All of these bulbs share in common the fact that their light source is surrounded, either immediately or with an intermediate, by a shell. The shell provides physical protection to the light source from the surrounding ambient air, as neither the partial vacuum of an incandescent filament, nor the plasma column of a fluorescent, nor the fluid, gel or plastic of an LED bulb will normally withstand direct exposure to ambient air (or ambient surroundings). In the case of air surrounding the LEDs in an LED bulb, the shell provides physical isolation of the LEDs from physical damage. While the shell provides physical isolation for the internal components of the bulb, it has the drawback that the commonly used shell materials, glass or plastic, have a different index of refraction than does the surrounding ambient air (or ambient surroundings). Further, in the case of the LED bulb using a fluid, gel or plastic, the index of refraction of the shell does not match that of the internal fluid, gel or plastic either. This mismatch of index of refraction creates reflection of the impinging light at the material interface, resulting in loss of light output.

This invention has the object of developing a light emitting apparatus, such that the above-described primary problem is effectively solved. In accordance with an exemplary embodiment, the light emitting apparatus provides a bulb constructed similarly to that of currently available bulbs, but without the light losses associated with reflections from the shell enclosing the bulb. In accordance with an embodiment, the bulb includes a shell, constructed of glass or plastic. The shell has an anti-reflective coating on the inside (i.e., an inner surface) and/or outside (i.e., an outer surface) of the shell. In accordance with an exemplary embodiment, the anti-reflective coatings are designed such that reflections from the interfaces from the inside to the shell, and from the shell to the ambient air or ambient surroundings are minimized.

SUMMARY OF THE INVENTION

In accordance with one embodiment, an incandescent bulb comprises: an incandescent filament; a partially evacuated glass shell surrounding the filament, the shell being potentially filled with a gas; an anti-reflective coating on the inside (or an inner surface) of the shell to match the index of refraction of the interior partial vacuum to that of the glass; and/or an anti-reflective coating on the outside (or an outer surface) of the shell to match the index of refraction of the glass shell to that of the ambient air or surroundings.

In accordance with another embodiment, a fluorescent bulb comprises: a partially evacuated glass tube; the glass tube being potentially filled with a gas; the glass tube also being filled with a material suitable for causing ultraviolet emissions; a phosphorescent material lining the inside (or inner surface) of the glass tube to convert the ultraviolet emissions to visible light; and an anti-reflective coating on the outside (or outer surface) of the glass tube to match the index of refraction of the glass tube to that of the ambient air or surroundings.

In accordance with a further embodiment, an LED bulb comprises: at least one LED; a glass or plastic shell surrounding the at least one LED, the shell being potentially filled with air, fluid, gel or plastic; an anti-reflective coating on the inside (or inner surface) of the shell to match the index of refraction of the interior air, fluid, gel or plastic to that of the glass or plastic; and/or an anti-reflective coating on the outside (or outer surface) of the shell to match the index of refraction of the glass or plastic shell to that of the ambient air or surroundings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
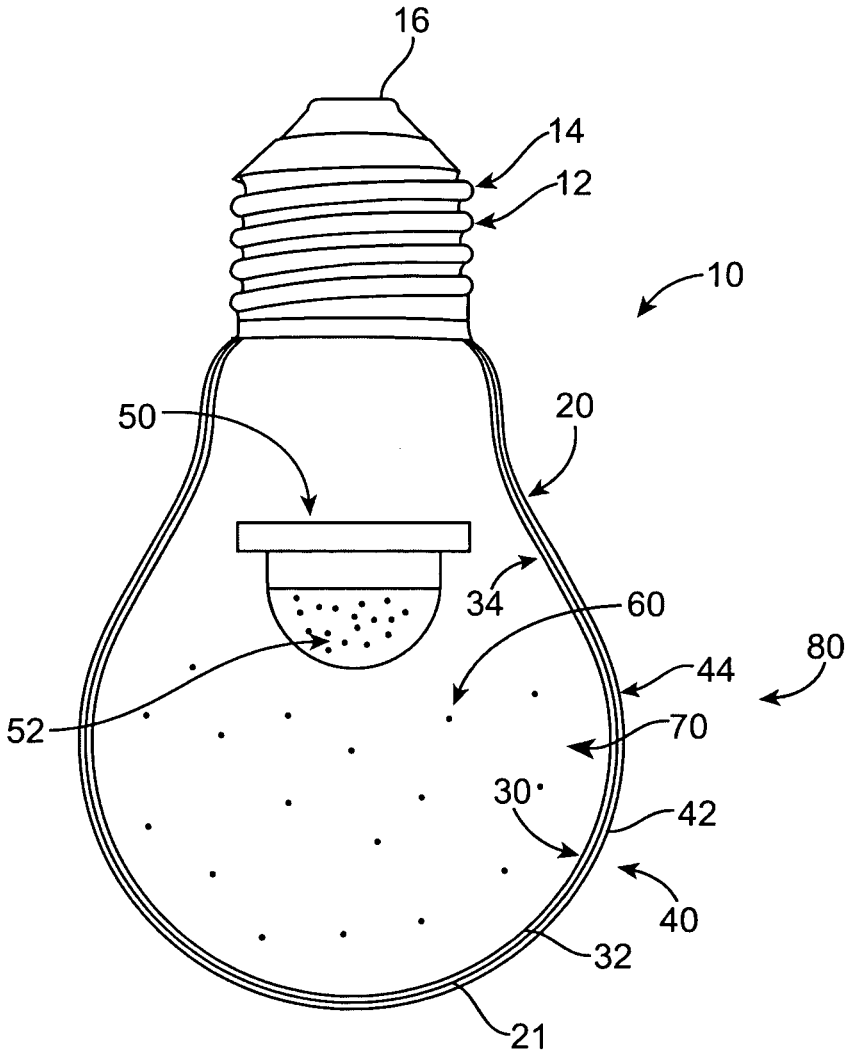
FIG. 1 is a cross-sectional view of a light bulb having a shell, and showing anti-reflective coatings on the interior (or inner) and exterior (or outer) surfaces of the shell.

Reference will now be made in detail to the present preferred embodiments of the invention, examples of which are illustrated in the accompanying drawings. Wherever possible, the same reference numbers are used in the drawings and the description to refer to the same or like parts. According to the design characteristics, a detailed description of each preferred embodiment is given below.

FIG. 1 shows a cross-sectional view of a light bulb 10 showing the shell 20 enclosing a light source 50 according to one embodiment. The light bulb 10 includes a screw-in base 12, which includes a series of screw threads 14 and a base pin 16. The screw-in base 12 is configured to fit within and make electrical contact with a standard electrical socket. The electrical socket is preferably dimensioned to receive an incandescent or other standard light bulb as known in the art. However, it can be appreciated that the screw-in base 12 can be modified to fit within any electrical socket, which is configured to receive an incandescent bulb, such as a bayonet style base. The screw-in base 12 makes electrical contact with the AC power in a socket through its screw threads 14 and its base pin 16.

In accordance with various embodiments, the light source 50 can be an incandescent filament, a plasma column of a fluorescent bulb, or a LED (light emitting diode). For example as shown in FIG. 1, the light bulb 10 includes an inner anti-reflective coating 30 and an outer anti-reflective coating 40, which are on the inner or interior surface 32 and the outer or exterior surface 42, respectively, of the shell 20. The inner anti-reflective coating 30 is of such a thickness 34 that the index of refraction of the shell 20 and/or shell material 21 is substantially matched to the index of refraction of the inner portion 70 of the bulb 10 and/or a material 60 within the inner portion 70 of the bulb 10. In an alternative embodiment, the outer anti-reflective coating 40 is of such a thickness 44 that the index of refraction of the shell 20 and/or shell material 21 is substantially matched to the index of refraction of the external atmosphere 80 (or ambient surroundings) of the shell 20. It can be appreciated that the shell 20 (or enclosure) may be any shape, or any of the other conventional or decorative shapes used for bulbs, including but not limited to spherical, cylindrical, and "flame" shaped shells 20. Alternatively, the shell 20 could be a tubular element, as used in fluorescent lamps or other designs and shown in FIG. 2.

In accordance with an exemplary embodiment, the light bulb 10 includes at least one LED 52, and a glass or plastic outer shell 20 surrounding an interior or an inner portion 70 of the bulb 10, which houses the at least one LED 52. The inner portion 70 of the shell 20 can be filled or partially filled with a material 60 such as air, fluid, gel and/or a plastic or plastic material. In accordance with an exemplary embodiment, an anti-reflective coating 30 can be placed or applied to the inside 32 (or inner surface) of the shell 20 to match the index of refraction of the interior (or an inner portion) 70 of the bulb 10 to that of the glass or plastic shell 20. In addition, an anti-reflective coating 30 can be placed or applied to the inside 32 (or inner surface) of the shell 20 to match the index of refraction of the material 60. Alternatively, the interior 70 of the shell 20 can be fully evacuated or partially evacuated, and an anti-reflective coating 30 can be placed or applied to the inside 32 (or inner surface) of the shell 20 to match the index of refraction of the full or partial vacuum thus created. In accordance with another exemplary embodiment, an anti-reflective coating 40 can be placed or applied to the outside 42 (or outer surface) of the shell 20 to match the index of refraction of the glass or plastic shell 20 to that of the ambient air or surroundings 80.

Figure 2:
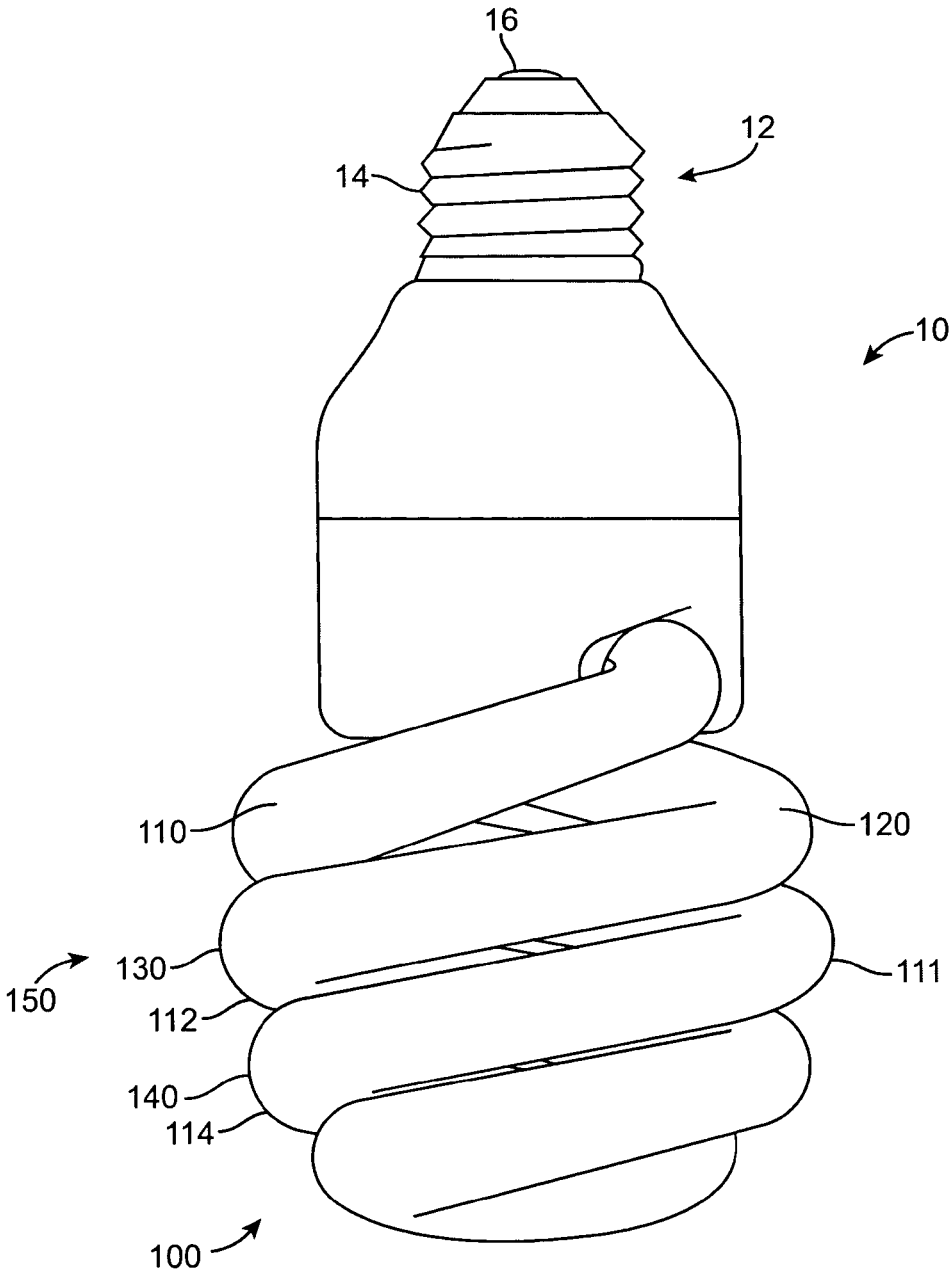
FIG. 2 is a perspective view of a fluorescent light bulb, which includes a phosphorescent material lining the inside of the tube that converts the fluorescent radiation into visible radiation, and an anti-reflective coating on an outer surface of the tube.

In accordance with another exemplary embodiment, as shown in FIG. 2, the light bulb 10 is a fluorescent bulb 100, which includes a tube 110, one or more substances 120 inside the tube 110, and wherein at least one of the one or more substances 120 fluoresces when properly excited. For example, the tube 110 can be partially evacuated and filled with a gas or material suitable for causing ultraviolet emissions. In accordance with an exemplary embodiment, the bulb 10 includes one or more substances 120 in the form of a phosphorescent material 130 lining the inside or inner surface 112 of the tube 110 that converts the fluorescent radiation (or ultraviolet emissions) into visible radiation (or visible light).

In accordance with another exemplary embodiment, an anti-reflective coating 140 can be applied or placed on an outer surface 114 of the tube 110. The anti-reflective coating 140 matches an index of refraction of an external atmosphere 150 with an index of refraction of the tube 110 and/or tube material 111. The tube 110 is preferably made of glass; however, other suitable materials can be used. In addition, the tube 110 is preferably partially evacuated.

As shown in FIG. 2, the light bulb 10 also includes a screw-in base 12, which includes a series of screw threads 14 and a base pin 16 The screw-in base 12 is configured to fit within and make electrical contact with a standard electrical socket. The electrical socket is preferably dimensioned to receive an incandescent or other standard light bulb as known in the art. However, it can be appreciated that the screw-in base 12 can be modified to fit within any electrical socket, which is configured to receive an incandescent bulb, such as a bayonet style base. The screw-in base 12 makes electrical contact with the AC power in a socket through its screw threads 14 and its base pin 16.

It can be appreciated that the light bulb as shown in FIGS. 1 and 2 is shown as a replacement bulb for standard incandescent bulbs, however, the bulb 10 can be adapted to usage with any other powering system or configuration, and can be used for any lighting system, including incandescent bulbs, flashlights, headlights for automobiles or motorcycles, and lanterns.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An incandescent bulb comprising:
an incandescent filament;
a shell surrounding said filament, wherein the shell has a shell index of refraction;
an anti-reflective coating on an inner surface of the shell, wherein the anti-reflective coating has an inner surface index of refraction; and
wherein the shell index of refraction and the inner surface index of refraction in combination matches an index of refraction of an inner portion of the bulb.

2. The incandescent bulb as set forth in claim 1, wherein the shell is glass.

3. The incandescent bulb as set forth in claim 1, wherein the shell is partially evacuated.

4. The incandescent bulb as set forth in claim 1, wherein the shell is a bulb-shaped shell.

5. An incandescent bulb comprising:
an incandescent filament;
a shell surrounding said filament, wherein the shell has a shell index of refraction;
an anti-reflective coating on an outer surface of the shell, wherein the anti-reflective coating has an outer surface index of refraction; and
wherein the shell index of refraction and the outer surface index of refraction in combination matches an index of refraction of an external atmosphere.

6. The incandescent bulb as set forth in claim 5, wherein the shell is glass.

7. The incandescent bulb as set forth in claim 5, wherein the shell is partially evacuated.

8. The incandescent bulb as set forth in claim 5, wherein the shell is a bulb-shaped shell.

9. An incandescent bulb comprising:
an incandescent filament;

a shell surrounding said filament, wherein the shell has a shell index of refraction;

an anti-reflective coating on an inner surface of the shell, wherein the anti-reflective coating has an inner surface index of refraction;

another anti-reflective coating on an outer surface of the shell, wherein the other anti-reflective coating has an outer surface index of refraction; and wherein:

the shell index of refraction and the inner surface index of refraction in combination matches an index of refraction of an inner portion of the bulb, and the shell index of refraction and the outer surface index of refraction in combination matches an index of refraction of an external atmosphere.

10. The incandescent bulb as set forth in claim 9, wherein the shell is glass.

11. The incandescent bulb as set forth in claim 9, wherein the shell is partially evacuated.

12. The incandescent bulb as set forth in claim 9, wherein the shell is a bulb-shaped shell.

13. A fluorescent bulb comprising:

a tube having a tube index of refraction;

one or more substances inside the tube, at least one of which fluoresces when properly excited;

a phosphorescent material lining the inside of the tube that converts the fluorescent radiation into visible radiation;

an anti-reflective coating on an outer surface of the tube, wherein the anti-reflective coating has an outer surface index of refraction; and wherein the tube index of refraction and the outer surface index of refraction in combination matches an index of refraction of an external atmosphere.

14. The fluorescent bulb as set forth in claim 13, wherein the tube is glass.

15. The fluorescent bulb as set forth in claim 13, wherein the tube is partially evacuated.

16. An LED bulb comprising:

one or more LEDs;

a shell surrounding said one or more LEDs, wherein the shell has a shell index of refraction;

an anti-reflective coating on an inner surface of the shell, wherein the anti-reflective coating has an inner surface index of refraction; and wherein the shell index of refraction and the inner surface index of refraction in combination matches an index of refraction of an inner portion of the bulb.

17. The LED bulb as set forth in claim 16, wherein the shell is glass.

18. The LED bulb as set forth in claim 16, wherein the shell is plastic.

19. The LED bulb as set forth in claim 16, wherein the shell is at least partially filled with air.

20. The LED bulb as set forth in claim 16, wherein the shell is at least partially filled with a fluid.

21. The LED bulb as set forth in claim 16, wherein the shell is at least partially filled with a gel.

22. The LED bulb as set forth in claim 16, wherein the shell is at least partially filled with a plastic material.

23. The LED bulb as set forth in claim 16, wherein the shell is a bulb-shaped shell.

24. An LED bulb comprising:

one or more LEDs;

a shell surrounding said one or more LEDs, wherein the shell has a shell index of refraction;

an anti-reflective coating on the outer surface of the shell, wherein the anti-reflective coating has an outer surface index of refraction, and wherein the shell index of refraction and the outer surface index of refraction in combination matches an index of refraction of an external atmosphere.

25. The LED bulb as set forth in claim 24, wherein the shell is glass.

26. The LED bulb as set forth in claim 24, wherein the shell is plastic.

27. The LED bulb as set forth in claim 24, wherein the shell is at least partially filled with air.

28. The LED bulb as set forth in claim 24, wherein the shell is at least partially filled with a fluid.

29. The LED bulb as set forth in claim 24, wherein the shell is at least partially filled with a gel.

30. The LED bulb as set forth in claim 24, wherein the shell is at least partially filled with a plastic material.

31. The LED bulb as set forth in claim 24, wherein the shell is a bulb-shaped shell.

32. An LED bulb comprising:

one or more LEDs;

a shell surrounding said one or more LEDs, wherein the shell has a shell index of refraction;

an anti-reflective coating on an inner surface of the shell, wherein the anti-reflective coating has an inner surface index of refraction;

another anti-reflective coating on an outer surface of the shell, wherein the other anti-reflective coating has an outer surface index of refraction ; and wherein:

the shell index of refraction and the inner surface index of refraction in combination matches an index of refraction of an inner portion of the bulb, and the shell index of refraction and the outer surface index of refraction in combination matches an index of refraction of an external atmosphere.

33. The LED bulb as set forth in claim 32, wherein the shell is glass.

34. The LED bulb as set forth in claim 32, wherein the shell is plastic.

35. The LED bulb as set forth in claim 32, wherein the shell is at least partially filled with air.

36. The LED bulb as set forth in claim 32, wherein the shell is at least partially filled with a fluid.

37. The LED bulb as set forth in claim 32, wherein the shell is at least partially filled with a gel.

38. The LED bulb as set forth in claim 32, wherein the shell is at least partially filled with a plastic material.

39. The LED bulb as set forth in claim 32, wherein the shell is a bulb-shaped shell.

* * * * *

UNITED STATES PATENT AND TRADEMARK OFFICE

CERTIFICATE OF CORRECTION

PATENT NO. : 8,471,445 B2
APPLICATION NO. : 13/059394
DATED : June 25, 2013
INVENTOR(S) : Ronald J. Lenk It is certified that error appears in the above-identified patent and that said Letters Patent is hereby corrected as shown below:

In the Claims

In column 6, line 37, in claim 32, delete “refraction ;” and insert -- refraction; --, therefor.

Signed and Sealed this
Fifteenth Day of July, 2014

Michelle K. Lee

Michelle K. Lee
*Deputy Director of the United States Patent and Trademark Office*